US005602360A

United States Patent [19]

Sakamoto et al.

[11] Patent Number: 5,602,360

[45] Date of Patent: Feb. 11, 1997

[54] ELECTRONIC DELAY IGNITER AND ELECTRIC DETONATOR

[75] Inventors: Midori Sakamoto; Masaaki Nishi, both of Nobeoka, Japan

[73] Assignee: Asahi Kasei Kogyo Kabushiki Kaisha, Osaka, Japan

[21] Appl. No.: 454,376

[22] PCT Filed: Mar. 27, 1995

[86] PCT No.: PCT/JP95/00557

§ 371 Date: Jun. 7, 1995

§ 102(e) Date: Jun. 7, 1995

[87] PCT Pub. No.: WO96/03614

PCT Pub. Date: Feb. 8, 1996

[30] Foreign Application Priority Data

Jul. 28, 1994 [JP] Japan ..... 6-177113
Sep. 7, 1994 [JP] Japan ..... 6-213577

[51] Int. Cl.[6] ..... F23Q 7/02; C06B 29/02

[52] U.S. Cl. ..... 102/220; 102/218; 102/264; 102/202.13; 102/292; 149/68; 149/77; 149/78

[58] Field of Search ..... 102/218, 220, 102/264, 202.13, 292; 149/68, 77, 78

[56] References Cited

U.S. PATENT DOCUMENTS

| | | | |
|---|---|---|---|
| 3,575,114 | 4/1971 | Quist et al. | 102/70.2 |
| 3,793,100 | 2/1974 | Fronabarger | 149/77 |
| 4,047,482 | 9/1977 | Kervizic et al. | 102/19.2 |
| 4,328,751 | 5/1982 | Oswald | 102/215 |
| 4,445,435 | 5/1984 | Oswald | 102/220 |
| 4,487,125 | 12/1984 | Zuk | 102/220 |
| 4,586,437 | 5/1986 | Miki et al. | 102/220 |
| 4,696,231 | 9/1987 | Bryan | 102/202.5 |
| 4,712,477 | 12/1987 | Aikou et al. | 102/220 |
| 5,182,417 | 1/1993 | Rontey et al. | 102/202.14 |
| 5,341,742 | 8/1994 | Alford et al. | 102/202.8 |
| 5,440,991 | 8/1995 | Lewis et al. | 102/218 |
| 5,533,454 | 7/1996 | Ellis et al. | 102/202.1 |

FOREIGN PATENT DOCUMENTS

| | | |
|---|---|---|
| 0212111 | 3/1987 | European Pat. Off. . |
| 61-111989 | 5/1986 | Japan . |
| 63-53479 | 10/1988 | Japan . |
| 4-16582 | 1/1992 | Japan . |
| 5-79797 | 3/1993 | Japan . |
| 5-99597 | 4/1993 | Japan . |
| 2195420 | 4/1988 | United Kingdom . |

*Primary Examiner*—Peter A. Nelson
*Attorney, Agent, or Firm*—Finnegan, Henderson, Farabow, Garrett & Dunner, L.L.P.

[57] ABSTRACT

An electronic delay igniter including a firing capacitor (102) for storing energy required for firing by applying a voltage from an external power supply, an electronic timer unit (206) provided with a solid state oscillator driven by the energy stored in the firing capacitor (102) to output an output signal after a predetermined delay time, a switching unit (104) for receiving the output signal to transmit the firing energy to an ignition unit (107), and the ignition unit (107) having a ignition charge which ignites on receiving the firing energy, a voltage from the external power supply has a voltage application region where the electronic timer (206) is operated to operate the switching unit (104), but the ignition charge does not ignite even when the energy from the firing capacitor (102) is received.

24 Claims, 4 Drawing Sheets

ELECTRONIC DELAY IGNITER AND ELECTRIC DETONATOR

TECHNICAL FIELD

The present invention relates to an igniter having a high-precision delay time, and, more particularly to an electronic delay electric detonator mainly used for firing an explosive to demolish rocks.

BACKGROUND TECHNOLOGY

An electronic delay igniter, as a substitute for a prior art chemical reaction-type igniter using a combustible composition, has been developed for greatly improving the precision of firing time. Electronic delay igniters, such as those disclosed in U.S. Pat. No. 4,445,435, U.S. Pat. No. 4,586,437, U.S. Pat. No. 4,712,477, Japanese Patent Application Publication No. 53479/1988. Japanese Patent Application Laid Open No. 111989/1986, Japanese Patent Application Laid Open No. 16582/1992, Japanese Patent Application Laid Open No. 79797/1993, are known.

These electronic delay detonators are divided into an analog type and a digital type depending on the delay means of the electronic timer unit, and the following three types are known.

The first is an analog type electronic timer using a CR circuit disclosed in U.S. Pat. No. 4,712,477. FIG. 1 is a block diagram of an electronic delay igniter using a CR circuit. As shown in the Figure, in this example, a resistor 1 and a capacitor 2 form a time constant circuit 3. The time constant circuit 3 is connected with a comparator circuit 4 for comparing a voltage stored in the capacitor 2 with a predetermined voltage, which detects a time at which the voltage stored in the capacitor 2 is the predetermined voltage. That is, the analog electronic timer uses the predetermined time when energy is supplied from a blasting machine (not shown) until the predetermined voltage is stored in the capacitor 2 as a delay time to output an output pulse after the lapse of a predetermined delay time. On the other hand, a circuit having an input resistor 5, a rectifier 6, and a voltage dividing resistors 7 and 8 is formed in a signal input unit. Firing energy is temporarily stored in a firing capacitor 9 through a rectifier 6, and this energy is supplied to an ignition unit through a switch circuit released by the output pulse output from the electronic timer after the delay time. Here, the switch circuit comprises switches 10 and 11, a latch 12, and a switch 13, and the ignition unit comprises a heater 14, and an ignition charge 15 which is in contact with the heater 14. Delay time of the electronic timer can be arbitrarily set by adjusting the resistance of the resistor 1 or the capacitance of the capacitor 2.

The second is a digital type electronic timer using a CR pulse oscillator disclosed in U.S. Pat. No. 4,586,437, and FIG. 2 is a block diagram of an electronic delay igniter using a CR pulse oscillator. As shown in the Figure, delay means of the electronic timer comprises an electronic timer circuit 21, a capacitor 22 and a resistor 23 which are connected to the electronic timer circuit 21, in which repeated charge and discharge of the capacitor 22 is made by a combination of the capacitor 22 and the resistor 23, and pulses having a generated predetermined frequency are counted by a counter circuit incorporated in an electronic timer circuit to output an output pulse. A signal input unit for a signal from the blasting machine is provided with a rectifier 24, a firing capacitor 25, and a constant voltage circuit 26. Further, firing energy temporarily stored in the firing capacitor 25 is supplied to an ignition unit comprising a heater 28 and an ignition charge 29 through a switching unit 27 which is released by the output pulse output from the electronic timer circuit after the lapse of the delay time.

The third is a digital type electronic timer using a solid state oscillator such as a quartz oscillator, which is disclosed in U.S. Pat. No. 4,445,435, Japanese Patent Application Publication No. 53479/1988, Japanese Patent Application Laid Open No. 11198/1986, Japanese Patent Application Laid Open No. 16582/1992, Japanese Application Laid Open No. 79797/1993.

The operation sequence of the above-described first to third electronic delay electric detonators is almost the same. Specifically, when a certain amount of energy is supplied from the blasting machine to the firing capacitor, the electronic timer begins to operate and, after the lapse of a predetermined time, an output pulse signal is transmitted from the electronic timer unit (or a blasting machine) to the switching unit. On receiving the signal the switching unit is released, and the electric energy stored in the firing capacitor is supplied to the ignition unit. The ignition unit comprises a heater and an ignition charge contacting the heater. When the electric energy stored in the firing capacitor is supplied, the heater is heated and, when the heater surface temperature reaches the ignition temperature of the ignition charge, the ignition charge ignites, thereby supplying heat energy to the initiating unit. Thus, the electronic delay electric detonator is initiated.

Here, the time precision of the delay means of the first and second electronic delay electric detonators, when viewed from only the electronic delay unit, depends upon the CR circuit using CR. Since, in such a CR pulse oscillator circuit, the time precision is basically determined by the device characteristics of the capacitor C and the resistor R of the time constant circuit. For determining the time, a capacitance deviation or the like of the device must be allowed. For example, the time precision is±several μs to over 10 μs for a reference time of 1000 ms.

On the other hand, the third electronic delay electric detonator uses a solid state oscillator. In this case, since the solid state oscillator, itself, is high in oscillation precision, a time precision of±several tens of μs to several hundred μs can be obtained for a reference time of 1 second.

Considering the fact that prior art electric detonators using a combustible composition have a large deviation of 5 to 10% based on the reference time, these electronic delay electric detonators having delay means are sufficiently distinct when compared with such prior art electric detonators.

As described above, in the electronic delay electric detonator, operation of the electronic timer and other circuits and ignition of the ignition unit are carried out with only the electric energy stored in the firing capacitor. Therefore, it is preferable to use a capacitor having a capacity as large as possible, and to be charged to as high a voltage as possible in order to increase the charge amount, but in a practical design, an appropriate capacity must be selected so that the size is not too large. Further, even for firing multiple detonators, the charge voltage of the firing capacitor is required to be suppressed to about 25 V so that the firing voltage and the capacitance of blasting machine are not excessive. Therefore, the consumption current in the electronic timer and the firing energy in the ignition unit are normally suppressed as much as possible.

For an electric detonator, energy required for firing the ignition unit (minimum firing energy) includes several grades in terms of external electric hazard factors, such as stray current and leakage current. Normally a type of small energy of about 2 to 4 mJ is used.

On the other hand, such an igniter is naturally required to have a high initiation reliability. Normally, for an igniter such as an electric detonator, it is a legal obligation to perform a continuity test immediately prior to firing to check the firing circuit against abnormality, and it is particularly important for ignition reliability to check the continuity (resistance) of the firing circuit at the final step in the production process.

Naturally, for an electronic delay igniter, the firing circuit is also required to be checked as the final step of production in view of the ignition reliability. For the electronic delay igniter, in view of the nature of the circuit, it is required to operate the switching circuit in order to check the firing circuit. As a circuit check device, the inventors have developed a continuity checker for electronic delay electric detonator (Japanese Patent Application Laid Open No. 99597/1993).

Whether it is an electric detonator or an electronic delay electric detonator, checking the igniter must be carried out in the state provided with the ignition charge. Checking the firing circuit of the electric detonator is sufficient only by a continuity check. Since it is carried out using a small current of normally 10 mA, there is less danger of heating the heater to induce explosion. However, an electronic delay electric detonator has a difficult problem described below because the firing circuit mechanism differs from that of the prior art electric detonator.

When checking the firing circuit of the electronic delay electric detonator, it is necessary to operate the electronic timer for a predetermined period of time to obtain an output signal, and make sure that the switching unit operates. For this purpose, the firing capacitor is required to be subjected to a voltage higher than the operating voltage. Therefore, since the current in the ignition unit varies depending on the capacity of the capacitor, the voltage, and the heater resistance, and the like, in some cases, after the switching operation a substantial current may flow, leading to spontaneous explosion.

On the other hand, with recent advances in firing techniques, when blasting is attempted to be controlled by the initiation time, merely improving the time precision considerably in comparison to the prior art electric detonator is sufficient, in that a precision of ±0.5 ms is required, as will be described below.

In blasting, for example, the following estimation formula corresponds to a theory that an optimum initiation time difference is the time for explosion gas pressure generated by the explosive, to interact with the adjacent bore hole.

$DT=L\times1000/(V\times0.12)$

DT: optimum initiation time difference (ms)

L: hole interval (m)

V: elastic wave velocity in a breast site rock (m/s)

That is, it is said that the best blasting effect can be obtained when initiating the next hole under the action of explosion gas. Then, using the estimation formula, optimum initiation times for a light place and a place in tunnel are determined as follows.

For the light place, the hole interval is 3–5 m, and the calculation is as follows.

$$DT: = (3 \text{ to } 5)\times1000/V\times0.12) = 8 \text{ to } 20 \text{ ms}$$

wherein V (limestone)=2000 to 30000 m/s.

For a place in tunnel, the hole interval is less than 1 m, and the calculation is as follows.

$$DT = 1\times1000/(V\times0.12) = 1.7 \text{ to } 2.1 \text{ ms}$$

wherein V (medium hard rock)=4000 to 5000 m/s.

Therefore, with deviations according to the site conditions, in general, a time interval of 8 to 20 ms is optimum for a light place, and error must be less than ±2 ms when an allowance of ±10% is given. Further, for a place in tunnel where the hole interval is small, in particular for blasting hard rock, deviation must be less than ±0.5 ms in absolute precision.

Thus, in an electronic delay electric detonator with the aim of blasting control, an absolute precision of ±0.5 ms is required.

Therefore, in this case, the use of a digital type electronic timer having a solid state oscillator is essential as delay means. However, the use only of a digital timer is not always sufficient, to achieve high precision firing. For practically viable values of the capacity of the firing capacitor, the voltage, and the like, selection of the ignition charge is extremely important.

DISCLOSURE OF THE INVENTION

Under the above-described circumstances, an object of the present invention is to provide a safe electronic delay igniter which does not undergo spontaneous explosion even when the electronic timer is operated to operate the switching unit for checking the firing circuit of the electronic delay igniter.

Another object of the present invention is to provide an electronic delay igniter which achieves a high precision initiation time of within ±0.5 ms and is high in initiation reliability.

A further object of the present invention is to provide a safe electronic delay electric detonator which does not undergo spontaneous explosion even when the electronic timer is operated to operate the switching unit for checking the firing circuit of the electronic delay igniter.

A further object of the present invention is to provide an electronic delay electric detonator which achieves a high precision initiation time of within ±0.5 ms and is high in initiation reliability.

In a first aspect of the present invention, which attains the above object, an electronic delay igniter comprises: a firing capacitor for storing energy required for firing by applying a voltage from an external power supply, an electronic timer unit provided with a solid state oscillator driven by the energy stored in the firing capacitor to output an output signal after a preset delay time, a switching unit for transmitting the firing energy by the output signal, and an ignition unit having an ignition charge which ignites upon receiving the firing energy transmitted by the switching unit, wherein the voltage applied by the external power supply has a voltage application range where the electronic timer is operated to operate the switching unit, but the ignition charge does not ignite even when the energy from the firing capacitor is received.

Here, minimum ignition energy of the ignition unit may be more than $12.5\times C_0$ Joule, where a capacitance of the firing capacitor of the electronic timer is $C_0$ farad.

The capacitance $C_0$ of the firing capacitor may be $400\times 10^{-6}$ to $1200\times 10^{-6}$ farad.

The ignition charge may contain as effective ingredients: (a) at least one selected from the group consisting of lead styphnate, diazodinitrophenol, tetracene, silver azide, and lead azide; (b) a mixture of diazodinitrophenol and potassium chlorate; (c) a mixture of zirconium and potassium perchlorate; or (d) a mixture of at least one of potassium hexacyanoferrate and potassium hexacyanocobaltate and at least one of potassium perchlorate and potassium bichromate.

In a second aspect of the present invention, an electronic delay igniter comprises: a firing capacitor for storing an energy required for firing by applying a voltage from an external power supply, an electronic timer unit provided with a solid state oscillator for outputting an output signal after a preset delay time, a switching unit for transmitting the firing energy by the output signal, and an ignition unit having a ignition charge which ignites on receiving the firing energy transmitted by the switching unit, wherein the ignition charge contains as effective ingredients: (a) at least one selected from the group consisting of lead styphnate, diazodinitrophenol, tetracene, silver azide, and lead azide; (b) a mixture of diazodinitrophenol and potassium chlorate; (c) a mixture of zirconium and potassium perchlorate; or (d) a mixture of at least one of potassium hexacyanoferrate and potassium hexacyanocobaltate and at least one of potassium perchlorate and potassium bichromate.

In a third aspect of the present invention, an electronic delay electric detonator comprises: a firing capacitor for storing energy required for firing by applying a voltage from an external power supply, an electronic timer unit provided with a solid state oscillator driven by the energy stored in the firing capacitor to output an output signal after a preset delay time, a switching unit for transmitting the firing energy by the output signal, and an ignition unit having an ignition charge which ignites on receiving the firing energy transmitted by the switching unit, wherein the voltage application region from the external power supply has a voltage application region where the electronic timer is operated to operate the switching unit, but the ignition charge does not ignite even when the energy from the firing capacitor is received.

Here, the minimum ignition energy of the ignition unit is, for example, more than $12.5\times C_0$ Joule when a capacitance of the firing capacitor of the electronic timer is $C_0$ farad.

The capacitance $C_0$ of the firing capacitor may be $400\times 10^{-6}$ to $1200\times 10^{-6}$ farad.

The ignition charge may contain as effective ingredients: (a) at least one selected from the group consisting of lead styphnate, diazodinitrophenol, tetracene, silver azide, and lead azide; (b) a mixture of diazodinitrophenol and potassium chlorate; (c) a mixture of zirconium and potassium perchlorate; or (d) a mixture of at least one of potassium hexacyanoferrate and potassium hexacyanocobaltate and at least one of potassium perchlorate and potassium bichromate.

In a fouth aspect of the present invention, an electronic delay electric detonator comprising: a firing capacitor for storing energy required for firing by applying a voltage from an external power supply, an electronic timer unit provided with a solid state oscillator for outputting an output signal after a preset delay time, a switching unit for transmitting the firing energy by the output signal, an ignition unit having an ignition charge which ignites on receiving the firing energy transmitted by said switching unit, and an initiating unit which initiates explosion by firing of said ignition charge, wherein said ignition charge contains as effective ingredients: (a) at least one selected from the group consisting of lead styphnate, diazodinitrophenol, tetracene, silver azide, and lead azide; (b) a mixture of diazodinitrophenol and potassium chlorate; (c) a mixture of zirconium and potassium perchlorate; or (d) a mixture of at least one of potassium hexacyanoferrate and potassium hexacyanocobaltate and at least one of potassium perchlorate and potassium bichromate.

In general, energy applied to the ignition unit, where the capacitance of the firing capacitor is C, and the charge voltage is V, is given as $(1/2)CV^2$. The charge voltage must be 2.5 V at the lowest for driving the firing circuit. Further, the upper limit of the charge voltage must be suppressed to about 25 V at the highest in view of capacity limitation of the blasting machine for charging the firing capacitor.

To design a practical electronic delay igniter, it is first required to set the firing circuit inspection voltage to 2.5 to 3.0 V, and voltage safety to more than about 2 V. That is, within the range of 2.5 V to 5 V, the electronic timer operates and the switching unit operates, but the ignition unit will not ignite with the charge voltage. The present invention is characterized by such a voltage application range, and it is preferable that the voltage application range has a range considering voltage safety of about 2 V.

Further, the charge voltage of the firing capacitor during blasting may be set to a normal charge voltage of 15 to 25 V, with a voltage allowance of more than 3 V. That is, it is required that firing does not fail at a firing capacitor charge voltage of higher than 12 V.

Here, the voltage safety is a difference in voltage between the minimum firing voltage and the firing circuit inspection voltage, and the voltage allowance is the difference in voltage between the charge voltage of the firing capacitor at blasting and the minimum firing voltage. When the electronic timer is operated to delay the ignition time, since power is consumed for driving the circuit and the firing capacitor voltage drops, a voltage allowance of more than about 3 V is preferable.

Therefore, the minimum firing energy is preferably, $$(1/2)\times C_0\times 5^2=12.5\ C_0\ \textit{Joule}$$

and in general, it should be less than $$(1/2)\times C_0\times 122=72\ C_0\ \textit{Joule}.$$

wherein $C_0$ is a capacity of the firing capacitor. It is appropriate to set the capacity $C_0$ of the firing capacitor to 400 to 1200 μF in view of limitation to the size of the capacitor.

The minimum energy required for ignition is determined by the combination of a heater and the ignition charge. The heater can be made of a platinum-iridium wire, a Ni—Cr wire, or the like with various wire diameters.

Further, since the ignition unit is required to have a particularly small deviation in firing time, it is preferable to use an ignition charge of an initiating charge type which completes the reaction in a short time. Moreover, since the voltage and capacity of the firing capacitor are limited due to the compact size requirement, a short firing time at a low current is particularly important.

Specifically, at least one ignition charge selected from the group consisting diazodinitrophenol (DDNP), tetracene, lead styphnate, silver azide, lead azide, basic lead picrate, and acetylenecopper, or a mixture of DDNP and potassium chlorate, or a mixture of zirconium and potassium perchlorate, or a mixture of potassium hexacyanoferrate (or potassium hexacyanocobaltate) and potassium perchlorate (or potassium bichromate) can be used. Of these, lead styphnate is particularly preferable, and a basic salt thereof with a fine particle size of less than 150 μm is small in sensitivity deviation even at a low current and thus effective.

The inventors have found that an electronic delay igniter and an electronic delay electric detonator which allow inspection of the firing circuit with sufficient voltage safety can be obtained with the above-described construction, thus achieving the present invention.

Further, the inventors have conducted intensive studies on the relationship between the electronic timer unit and the ignition unit, and found that a precision of ±0.5 ms is achieved irrespective of the length of delay time using a combination of an electronic timer unit using a solid state oscillator and an ignition unit using an ignition charge comprising effective ingredients including the above substances (a) to (d), that is, (a) at least one selected from the group consisting of lead styphnate, diazodinitrophenol, tetracene, silver azide, and lead azide; (b) a mixture of diazodinitrophenol and potassium chlorate; (c) a mixture of zirconium and potassium perchlorate; or (d) a mixture of at least one of potassium hexacyanoferrate and potassium hexacyanocobaltate and at least one of potassium perchlorate and potassium bichromate, and accomplished the present invention. No example using the above substances (a) to (d) as a ignition charge of an electronic delay detonator has been known, and use of some of the substances is known merely in an example as an initiating charge (Japanese Patent Application Laid Open No. 16582/1992) and in an example as an ignition charge of an electric detonator of an instantaneous type having no delay means (as to lead styphnate in C.A. 982596, as to a mixture of potassium hexacyanoferrate and potassium perchlorate in U.S. Pat. No. 3,793,100).

In this case, the substance (a) used in the present invention can be used alone or as a mixture of two or more. Lead styphnate includes neutral lead styphnate and basic lead styphnate depending on the production method, and basic lead styphnate is more preferable. Content of $KClO_3$ is preferably less than 70% by weight. This is because when the $KClO_3$ content exceeds 70% by weight, reactivity of the ignition charge tends to decrease. Weight ratio of both substances within a range from 4:6 to 6:4 is particularly preferable.

When a composition containing the mixture (c) of Zr and $KClO_4$ is used as the ignition charge, ratio of both substances is preferably 3:7 to 6:4 by weight. Out of this range, reactivity of the ignition charge tends to decrease.

Further, when a mixture (d) of at least one of $K_3Fe(CN)_6$ and $K_3Co(CN)_6$ with $K_2Cr_2O_7$ is used as the ignition charge, ratio of both substances is preferably within a range of from 1:9 to 4:6. This is because, out of the range, reactivity of the ignition charge tends to decrease.

Further, when a mixture (d) of at least one of $K_3Fe(CN)_6$ and $K_3Co(CN)_6$ with $KClO_4$ is used as the ignition charge, ratio of both substances is preferably within a range of from 3:7 to 5:5. This is because, out of the range, reactivity of the ignition charge tends to decrease.

In the ignition charge of the present invention using the substances (a) to (c), the corresponding substance may be used, as is, or be simply mixed, but for an ignition charge using the substance (d), the mixture of the range is required to be dissolved in warm water, and then recrystallized from an alcohol such as 1-propanol or 2-propanol prior to use. Further, in the ignition charge of the present invention, a binder (granulating agent) may be added to these substances (mixture). As the binder, for example, methylcellulose may be used in an amount of up to about 0.01% by weight. Further, the ignition charge used in the present invention has the substances (a) to (d) as effective components, but other additives may be added as long as the effect of the present invention is not impaired.

The ignition unit which uses the ignition charge having the substances (a) to (d) as effective components, achieves a precision of ±0.5 ms regardless of the length of the delay time. This is precision which cannot be obtained with the prior art system, and an ignition unit using a prior art ignition charge comprising, for example, a mixture of antimony (Sb) and potassium perchlorate ($KClO_4$), or a mixture of lead rhodanate and potassium chlorate ($KClO_3$), and the like is not able to achieve a precision of ±0.5 ms.

DETAILED DESCRIPTION OF THE INVENTION

The present invention will be described in detail with reference to the drawings.

Figure 3:
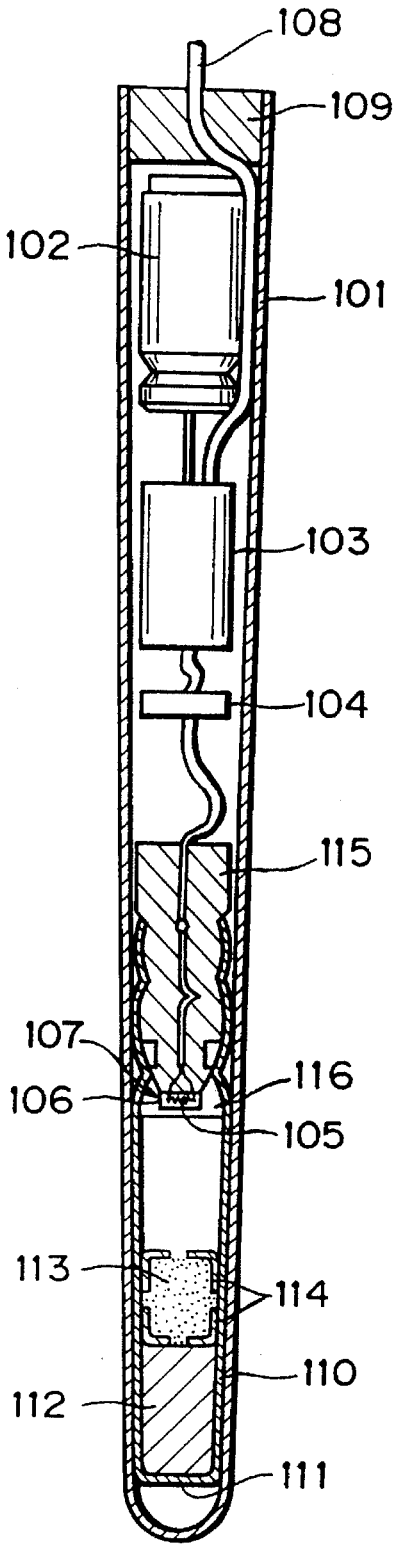
FIG. 3 is a schematic cross-sectional view showing construction of an electronic delay igniter and electric detonator according to an embodiment of the present invention.
Figure 4:
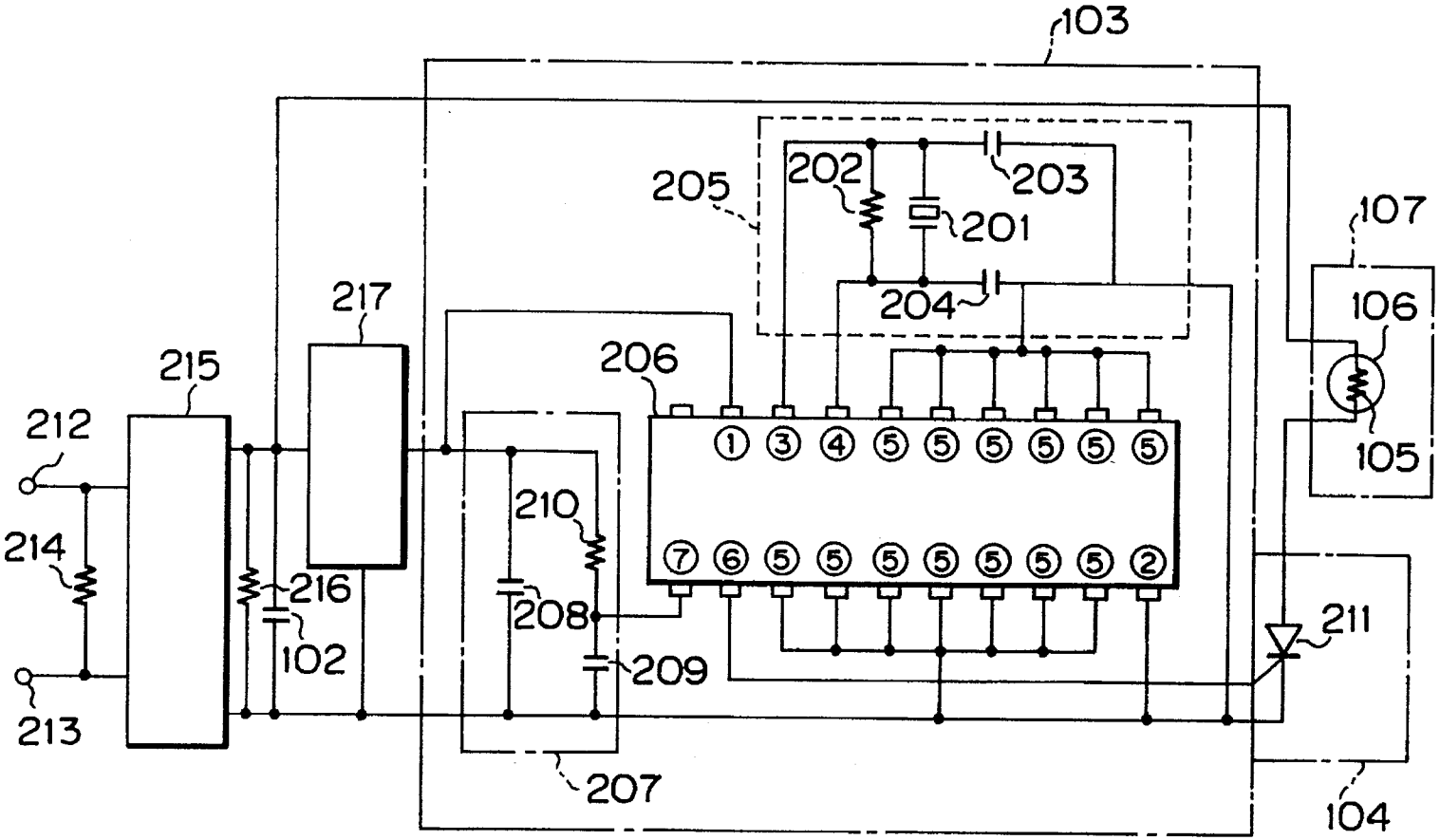
FIG. 4 is a block diagram of an igniter according to an embodiment of the present invention.

FIG. 3 is a schematic cross-sectional view showing an electronic delay electric detonator according to an embodiment. As shown in the Figure, a case 101 incorporates a firing capacitor 102 for storing energy required for firing, an electronic timer 103 provided with a solid state oscillator for outputting an output signal after a preset delay time, switching unit 104 transmitting the firing energy by the output signal from the electronic timer 103, and an ignition unit 107 having a heater 105 and a ignition charge 106, which ignites on receiving the firing energy transmitted by a switching unit 104. The firing capacitor 102, the electronic timer 103, the switching unit 104, and the ignition unit 107 constitute an electronic delay igniter according to one embodiment of the present invention, of which the block diagram is shown in FIG. 4. A leg or outer wire 108, which forms a pair of input terminals of the igniter, penetrates a cap 109 for sealing the case 101, projects outside the case 101. Further, shell 111 for holding an initiating unit 110 is disposed in the tip of the case 101. The shell 111 is charged with a base charge 112, and a pair of inner capsules 114 encompassing an initiating charge 113 from the front end and the rear end, are provided. Further, the rear end of the shell 111 is sealed with a plug 115, and the ignition unit 107 is disposed to face into a cup 116 provided at the tip of the plug 115.

As shown in FIG. 4, the electronic timer 103 comprises a quartz oscillator 201, a resistor 202 and capacitors 203 and 204, an oscillator circuit 205, a digital timer 206, and a reset hold circuit 207 for resetting a counter (not shown) in the digital timer during a rising time until the oscillator circuit 205 enters into steady-state oscillation. The reset hold circuit 207 comprises capacitors 208 and 209, and a resistor 210. The electronic timer 103 is designed so that pulses generated by the quartz oscillator 201 are counted by a counter circuit incorporated in the digital timer 206, and an output pulse is output when the count reaches a predetermined value. Further, the electronic timer 103 is connected to the ignition unit 107 comprising the resistor (heater) 105 and the ignition charge 106 through the switching unit 104. The switching unit 104 comprises a thyristor 211, which is released by the output pulse from the electronic timer 103 to transmit the firing energy stored in the firing capacitor 102 to the ignition unit 107. The delay time of the electronic timer 103 can be determined by changing the setting value of count number of the digital timer 206.

A signal input unit of the electronic delay igniter, a bypass resistor 214 and the input side of a rectifier 215 are connected between input terminals 212 and 213. The firing capacitor 102 and a discharge resistor 43 are connected between both ends at the output side of the rectifier 215. The bypass resistor 214 is for preventing the firing capacitor 102 from being charged by a voltage due to a stray current in the blasting site up to firing, and for dividing the blasting voltage uniformly, to some extent, for application to the rectifier 215 when a plurality of electronic delay igniters are connected in series for blasting. The rectifier 215 is to charge the firing capacitor 102 with blasting power having a predetermined polarity regardless of the polarity of the blasting power applied between the input terminals 212 and 213. The discharge resistor 216 is to discharge any charge in the firing capacitor 102 when discontinuing the blasting or the like.

A series circuit of the ignition unit 107 and the switching unit 104 having a control electrode is connected across both ends of the firing capacitor 102. Further, the input side of a voltage regulator 217 is connected to both ends of the firing capacitor 102, and the output side of the voltage regulator 217 is connected to the digital timer 206.

The digital timer 206 has a basic construction comprising the oscillator circuit 205, a counter for counting its oscillation output, and a coincidence detection circuit for detecting coincidence of the count value of the counter with a setting value, and more specifically, may have a construction as shown, for example, in Japanese Patent Application Laid Open No. 79797/1993. FIG. 4 shows an example in which a digital timer is formed as an integrated circuit. Terminals (1) and (2) of the digital timer 206 are connected to a pair of output terminals of the voltage regulator 217, a quartz or ceramic oscillator 201 is connected between terminals (3) and (4), the terminals (3) and (4) are connected to a ground terminal (2) through the capacitors 203 and 204, thirteen setting terminals are connected to the ground terminal (2), and a terminal (6) is connected to a gate of the thyristor 211. Various values corresponding to a desired delay time can be set by selectively discontinuing the thirteen setting terminals from the ground terminal (2).

The oscillator circuit 205 comprises the oscillator 201, the feedback resistor 202, and an internal circuit of the digital timer 206, oscillation output of the oscillator circuit 205 is counted by an internal counter and, when the count value of the counter coincides with the setting value, a coincidence detection output is output from the internal coincidence detection circuit to a terminal (6) to turn on the thyristor 211. Therefore, the blasting power stored in the firing capacitor 102 is supplied to the ignition unit 107 to ignite the ignition charge 106.

Further, when the ignition charge 106 thus ignites, the heat energy is supplied to the initiating unit 110, the initiating charge 113 is fired, and then the base charge 112 explodes. The base charge 112 and the initiating charge 113 can be conventional ones which have been used in the art. The base charge can be tetryl, penthrite, and the like, and the initiating charge 113 can be diazodinitrophenol, lead azide, and the like.

As described above, since the voltage output from the voltage regulator 217 drives the oscillator circuit 205 and the digital timer 206, the output voltage is required normally to be 2.5 to 5 V, and a smaller value of this voltage is preferable in design since consumption of the stored energy of the firing capacitor is reduced. In the present embodiment, the output voltage of the voltage regulator 217 is set to 2.5 V. To obtain the output voltage, it is required to apply a voltage of at least 2.8 V as the input voltage. Therefore, the charge voltage of the firing capacitor 102 for checking the firing circuit must be more than 2.8 V. In the present embodiment, 3.0 V is used for checking the firing circuit.

Further, the voltage safety is set to be more than 2 V and the minimum firing voltage is more than 5 V, that is, the ignition energy is to be $(1/2)\times 5^2\times C_0=12.5\times C_0$.

The minimum firing energy is determined by the combination of the heater and the ignition charge. The heater can be made of platinum-iridium (Pt—Ir) wire, Ni—Cr wire, or the like, and the wire diameter is varied to obtain various heater resistances.

Table 1 shows the specification of the ignition unit when electrolytic capacitors with $C_0$ of 470 μF and 1000 μF are used. The test temperature was normal temperature (30° C.). For comparison, one which has an ignition minimum firing energy of about $(1/2)\times 3^2\times C_0=4.5C_0$ was designed, and inspection results thereof are shown in Table 1.

TABLE 1

| | | Ignition unit specifications | | | | | | |
|---|---|---|---|---|---|---|---|---|
| No | Capacity of firing capacitor (μF) | Heater (wire diameter μm) | Firing composition | Minimum firing energy (mj) | *1 Voltage safety (V) | *2 Voltage allowance (V) | Firing circuit inspection | Ignition test |
| Embodiment 1 | 470 | Ni—Cr wire (50) | Tetracene | 7.6 | 2.7 | 9.3 | ○ | ○ |
| Embodiment 2 | 470 | Pt—Ir wire (50) | Lead styphnate | 17.4 | 5.6 | 6.4 | ○ | ○ |
| Embodiment 3 | 470 | Pt—Ir wire (50) | $Zr/KClO_4$ = 4/6 | 28.4 | 8.0 | 4.0 | ○ | ○ |
| Embodiment 4 | 1000 | Ni—Cr wire (50) | DDNP | 18.0 | 3.0 | 9.0 | ○ | ○ |

TABLE 1-continued

| No | Capacity of firing capacitor (μF) | Ignition unit specifications: Heater (wire diameter μm) | Firing composition | Minimum firing energy (mj) | *1 Voltage safety (V) | *2 Voltage allowance (V) | Firing circuit inspection | Ignition test |
|---|---|---|---|---|---|---|---|---|
| Embodiment 5 | 1000 | Pt—Ir wire (30) | $Zr/KCLO_4$ = 4/6 | 13.5 | 2.2 | 9.8 | ○ | ○ |
| Embodiment 6 | 1000 | Pt—Ir wire (50) | Lead styphnate | 19.2 | 3.2 | 8.8 | ○ | ○ |
| Embodiment 7 | 1000 | Pt—Ir wire (50) | Silver azide | 36.1 | 5.5 | 6.5 | ○ | ○ |
| Embodiment 8 | 1000 | Pt—Ir wire (60) | $Zr/KCLO_4$ = 4/6 | 58.3 | 7.8 | 4.2 | ○ | ○ |
| Comparative Example 1 | 1000 | Ni—Cr wire (30) | Tetracene | 3.7 | −0.3 | 12.3 | XX | — |
| Comparative Example 2 | 1000 | Ni—Cr wire (30) | Lead styphnate | 5.1 | 0.2 | 11.8 | X | — |

(*1): Voltage difference between charge voltage $\{(2E0/C0)^{1/2}\}$of the firing capacitor corresponding to the minimum firing energy (E0) and firing circuit inspection voltage (3 V).
(*2): Voltage difference between charge voltage (15 V) of the firing capacitor at blasting and charge voltage of the firing capacitor corresponding to the minimum firing energy.

The firing circuit of the electronic delay electric detonator using the ignition unit of the specification shown in Table 1 has been checked by charging the firing capacitor to 3 V. The individual embodiments have been checked with sufficient voltage safety (more than 4 V) but, in Comparative Example 1, all specimens have been fired in the circuit checks. Further, in Comparative Example 2, firing has occurred in the proportion of about one out of two times. Further, initiation test of the inspected electronic delay electric detonators of the individual embodiments has been conducted by charging the firing capacitor to 15 V, positive initiation has been noted in all cases even for a delay time of 8 seconds.

Figure 1:
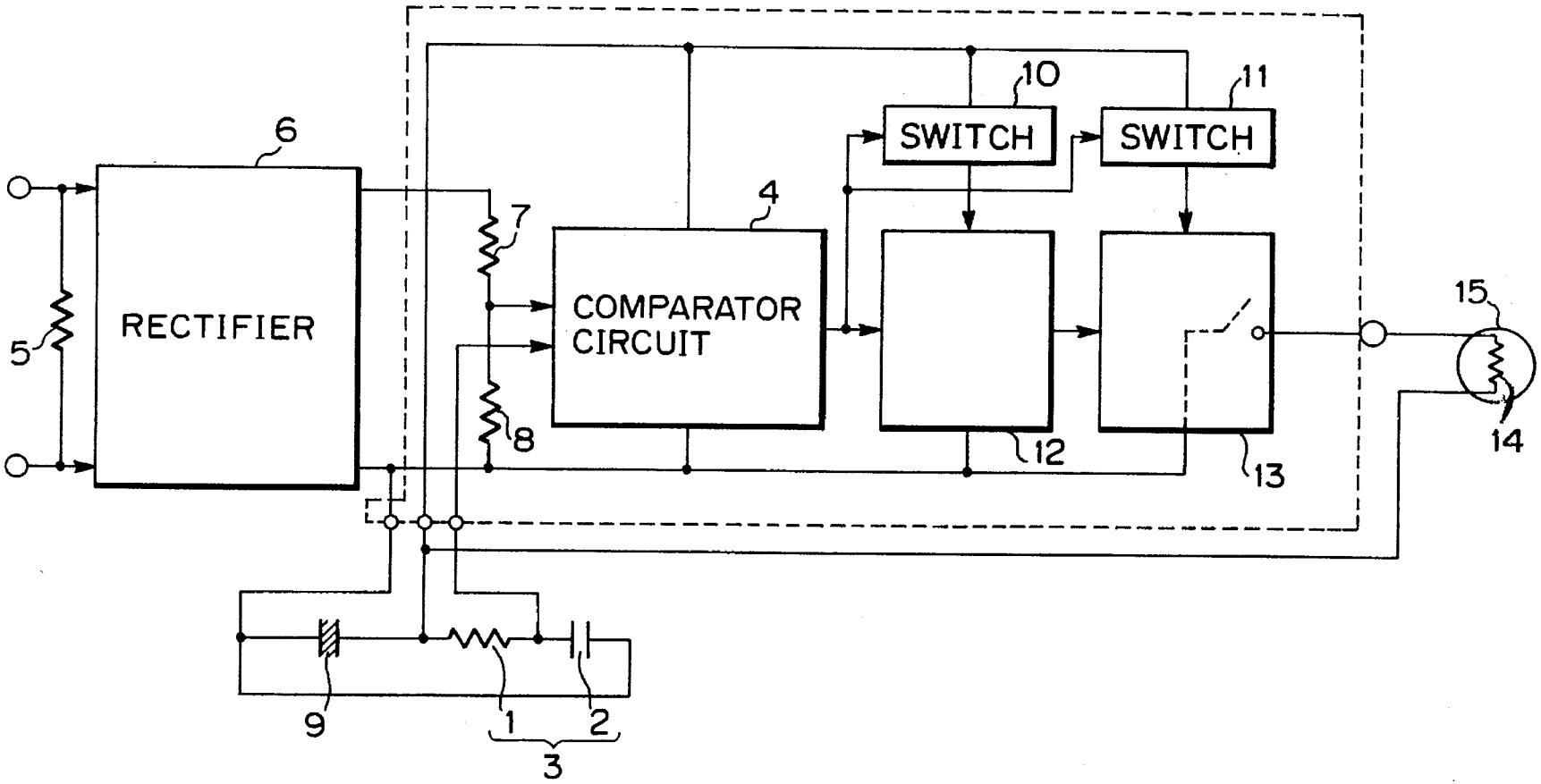
FIG. 1 is a block diagram showing an example of electronic delay igniter using an analog type electronic timer.
Figure 2:
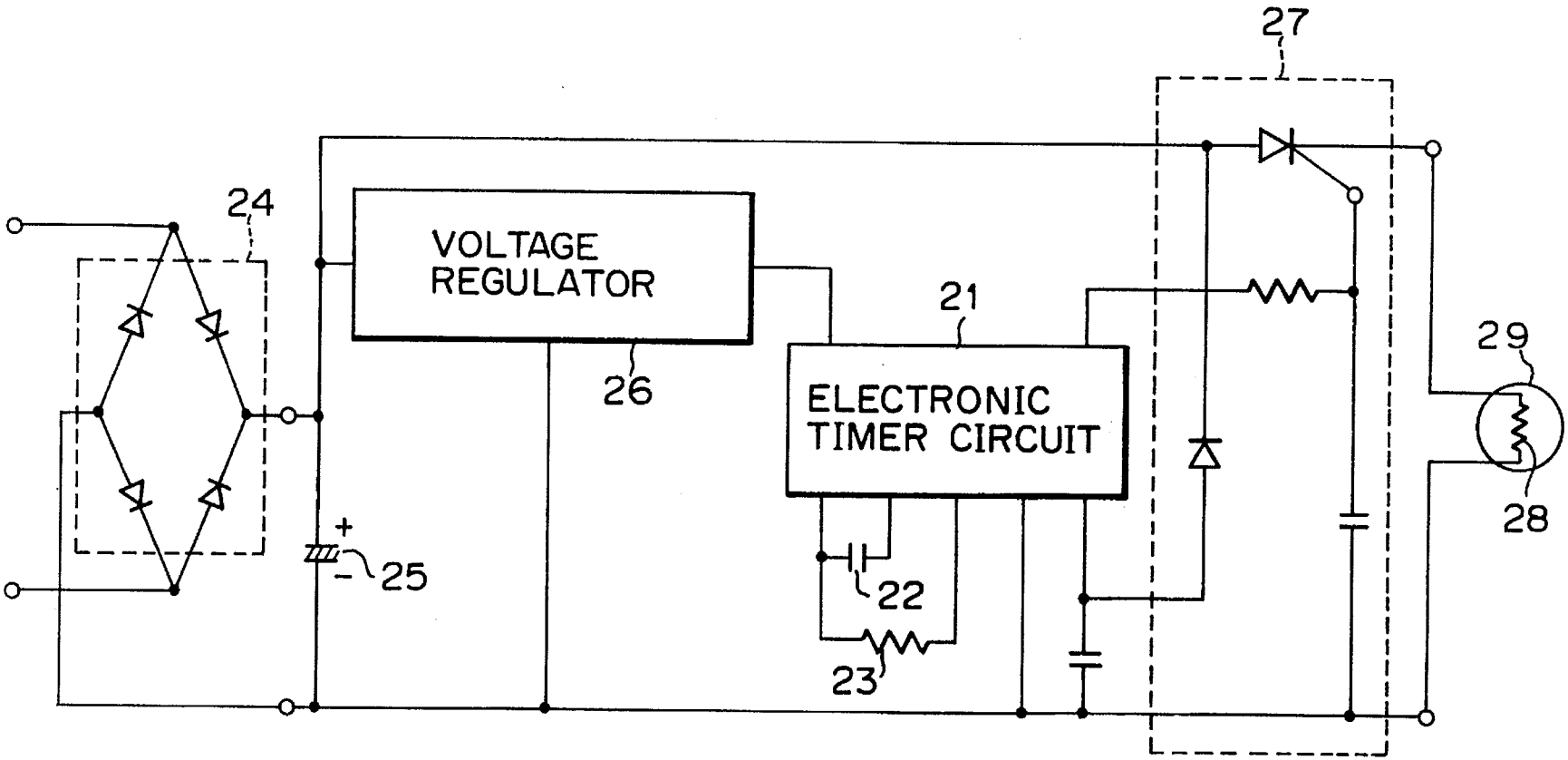
FIG. 2 is a block diagram showing an example of electronic delay igniter using a CR pulse oscillator.

In the electronic delay igniter shown in FIG. 1, with the firing capacitor 102 of a capacity of 1000 μF, the heater 105 of the ignition unit 107 made of a 30 μm diameter Pt—Ir wire (0.7 ohm), various ignition charges of the present invention have been used as the ignition charge 106, and subjected to initiation test. Also in the present embodiment, the output voltage of the constant-voltage circuit 217 was set to 2.5 V, and inspected for the firing circuit at a voltage of 3.0 V.

Further, an initiation test has been conducted individually using Sb-potassium perchlorate type ignition charge and lead rhodanate-potassium chlorate type ignition charge as the ignition charge 106. In this initiation test, the initiation time precision has been measured. (number of repetitions n=50). The application voltage was set to 15 V, and the reference time was set to 1000, 4000, and 8000 ms, respectively. The time precision test results are shown as deviation range in Table 2. Lead styphnate used in the embodiments was prepared using the procedure in which styphnic acid was added in warm water and caustic soda to obtain the sodium salt, the pH value was adjusted to 10 to 11 with caustic soda, lead nitrate was added, and washed with cool water.

TABLE 2

| Type of ignition charge | Reference time of electronic delay igniter: 1000 ms | 4000 ms | 8000 ms |
|---|---|---|---|
| Embodiment | | | |
| Basic lead styphnate | ±0.1 ms | ±0.1 ms | ±0.1 ms |
| DDNP | ±0.2 | ±0.2 | ±0.3 |
| Tetracene | ±0.2 | ±0.3 | ±0.3 |
| Lead azide | ±0.3 | ±0.4 | ±0.3 |
| Silver azide | ±0.2 | ±0.3 | ±0.3 |
| $DDNP/KC10_3$ = 50/50 | ±0.2 | ±0.2 | ±0.2 |
| $Zr/KC10_4$ = 40/80 | ±0.3 | ±0.4 | ±0.4 |
| $K_3Fe(CN)_6/KC10_4$ = 39/61 | ±0.3 | ±0.4 | ±0.3 |
| Comparative Example | | | |
| $Sb/KC10_4$ = 60/40 | ±1.1 | ±1.3 | ±1.5 |
| Lead rhodanate/$KC10_3$ = 90/40 | ±1.0 | ±1.1 | ±1.2 |

As can be seen from the Table 2, when the ignition charge of the present invention was used, a precision within ±0.5 ms was achieved irrespective of the reference time. Above all, lead styphnate and $DDNP/KClO_3$ (50/50) are particularly preferable in terms of precision, and further, use of basic lead styphnate shows a precision of less than ±0.1 ms, which is the most preferable. Comparative Examples using a conventional ignition charge were inferior in precision to the embodiments by one digit.

In the above described embodiments, examples of the igniter and detonator have been shown, and it is needless to say that these constructions are not restricted to the embodiments. For example, the igniter may be one which has a digital timer provided with a solid state oscillator, and is able to achieve the object of the present invention. Further, the construction of the detonator based on the igniter which is provided with the initiating unit is not specifically limited, but may be one which has an initiating unit making initiation by firing of the ignition charge. Here, the initiating unit means one which has at least an initiating charge, and as necessary, a base charge.

The electronic delay igniter and electric detonator of the present invention can be safely and positively inspected for the firing circuit in the form of the product, can provide a reliable initiation system, achieve a compact design acceptable to the market and further by using a specific substance as the ignition charge, achieve an initiation time precision of ±0.5 ms, thereby enabling precision and reliable blasting control.

We claim:

1. An electronic delay igniter comprising: a firing capacitor for storing energy required for firing by applying a voltage from an external power supply, an electronic timer unit provided with a solid state oscillator driven by the energy stored in said firing capacitor for outputting an output signal after a preset delay time, a switching unit for transmitting the firing energy by the output signal, and an ignition unit having an ignition charge which ignites on receiving the firing energy transmitted by said switching unit, wherein the voltage applied by the external power supply has a voltage application range where said electronic timer is operated to operate said switching unit, but said ignition charge does not ignite even when the energy from said firing capacitor is received.

2. An electronic delay igniter as claimed in claim 1, wherein a minimum ignition energy of said ignition unit is more than $12.5\times C_0$ Joule, where a capacitance of said firing capacitor of said electronic timer is $C_0$ farad.

3. An electronic delay igniter as claimed in claim 1 or claim 2, wherein the capacitance $C_0$ of said firing capacitor is $400\times10^{-6}$ to $1200\times10^{-6}$ farad.

4. An electronic delay igniter as claimed in claim 1 or claim 2, wherein said ignition charge contains as effective ingredients: (a) at least one selected from the group consisting of lead styphnate, diazodinitrophenol, tetracene, silver azide, and lead azide; (b) a mixture of diazodinitrophenol and potassium chlorate; (c) a mixture of zirconium and potassium perchlorate; or (d) a mixture of at least one of potassium hexacyanoferrate and potassium hexacyanocobaltate and at least one of potassium perchlorate and potassium bichromate.

5. An electronic delay igniter comprising: a firing capacitor for storing an energy required for firing by applying a voltage from an external power supply, an electronic timer unit provided with a solid state oscillator for outputting an output signal after a preset delay time, a switching unit for transmitting the firing energy by the output signal, and an ignition unit having a ignition charge which ignites on receiving the firing energy transmitted by said switching unit, wherein said ignition charge contains as effective ingredients: (a) at least one selected from the group consisting of lead styphnate, diazodinitrophenol, tetracene, silver azide, and lead azide; (b) a mixture of diazodinitrophenol and potassium chlorate; (c) a mixture of zirconium and potassium perchlorate; or (d) a mixture of at least one of potassium hexacyanoferrate and potassium hexacyanocobaltate and at least one of potassium perchlorate and potassium bichromate.

6. An electronic delay igniter as claimed in claim 5, wherein the effective ingredient of said ignition charge is basic lead styphnate.

7. An electronic delay igniter as claimed in claim 6, wherein said basic lead styphnate acid is a particulate having a particle diameter of less than 150 μm.

8. An electronic delay igniter as claimed in claim 5, wherein the effective ingredient of said ignition charge is a mixture of zirconium and potassium perchlorate, and a weight ratio of both substances is 4:6 to 6:4.

9. An electronic delay igniter as claimed in claim 5, wherein the effective ingredient of said ignition charge is a mixture of zirconium and potassium perchlorate, and a weight ratio of both substances is 3:7 to 6:4.

10. An electronic delay igniter as claimed in claim 5, wherein the effective ingredient of said ignition charge is a mixture of at least one of potassium hexacyanoferrate and potassium hexacyanocobaltate with potassium perchlorate, and a weight ratio of both substances is 3:7 to 5:5.

11. An electronic delay igniter as claimed in claim 5, wherein the effective ingredient of said ignition charge is a mixture of at least one of potassium hexacyanoferrate and potassium hexacyanocobaltate with potassium bichromate, and a weight ratio of both substances is 1:9 to 4:6.

12. An electronic delay electric detonator comprising: a firing capacitor for storing energy required for firing by applying a voltage from an external power supply, an electronic timer unit provided with a solid state oscillator driven by the energy stored in said firing capacitor for outputting an output signal after a preset delay time, a switching unit for transmitting the firing energy by the output signal, an ignition unit having a ignition charge which ignites on receiving the firing energy transmitted by said switching unit, and an initiating unit which initiates explosion by firing of said ignition charge, wherein the voltage applied by the external power supply has a voltage application range where said electronic timer is operated to operate said switching unit, but said ignition charge does not ignite even when the energy from said firing capacitor is received.

13. An electronic delay electric detonator as claimed in claim 12, wherein a minimum ignition energy of said ignition unit is more than $12.5\times C_0$ Joule, where a capacitance of said firing capacitor of said electronic timer is $C_0$ farad.

14. An electronic delay electric detonator as claimed in claim 12 or claim 13, wherein the capacitance $C_0$ of said firing capacitor is $400\times10^{-6}$ to $1200\times10^{-6}$ farad.

15. An electronic delay electric detonator as claimed in claim 12 or claim 13, wherein said ignition charge contains as effective ingredients: (a) at least one selected from the group consisting of lead styphnate, diazodinitrophenol, tetracene, silver azide, and lead azide; (b) a mixture of diazodinitrophenol and potassium chlorate; (c) a mixture of zirconium and potassium perchlorate; or (d) a mixture of at least one of potassium hexacyanoferrate and potassium hexacyanocobaltate and at least one of potassium perchlorate and potassium bichromate.

16. An electronic delay electric detonator comprising: a firing capacitor for storing energy required for firing by applying a voltage from an external power supply, an electronic timer unit provided with a solid state oscillator for outputting an output signal after a preset delay time, a switching unit for transmitting the firing energy by the output signal, an ignition unit having a ignition charge which ignites on receiving the firing energy transmitted by said switching unit, and an initiating unit which initiates explosion by firing of said ignition charge, wherein said ignition charge contains as effective ingredients: (a) at least one selected from the group consisting of lead styphnate, diazodinitrophenol, tetracene, silver azide, and lead azide; (b) a mixture of diazodinitrophenol and potassium chlorate; (c) a mixture of zirconium and potassium perchlorate; or (d) a mixture of at least one of potassium hexacyanoferrate and potassium hexacyanocobaltate and at least one of potassium perchlorate and potassium bichromate.

17. An electronic delay electric detonator as claimed in claim 16, wherein the effective ingredient of said ignition charge is basic lead styphnate.

18. An electronic delay electric detonator as claimed in claim 17, wherein said basic lead styphnate is a particulate having a particle diameter of less than 150 μm.

19. An electronic delay electric detonator as claimed in claim 16, wherein the effective ingredient of said ignition charge is a mixture of zirconium and potassium perchlorate, and a weight ratio of both substances is 4:6 to 6:4.

20. An electronic delay electric detonator as claimed in claim 16, wherein the effective ingredient of said ignition charge is a mixture of zirconium and potassium perchlorate, and a weight ratio of both substances is 3:7 to 6:4.

21. An electronic delay electric detonator as claimed in claim 16, wherein the effective ingredient of said ignition charge is a mixture of at least one of potassium hexacyanoferrate and potassium hexacyanocobaltate with potassium perchlorate, and a weight ratio of both substances is 3:7 to 5:5.

22. An electronic delay electric detonator as claimed in claim 16, wherein the effective ingredient of said ignition charge is a mixture of at least one of potassium hexacyanoferrate and potassium hexacyanocobaltate with potassium bichromate, and a weight ratio of both substances is 1:9 to 4:6.

23. An electronic delay igniter as claimed in claim 3, wherein said ignition charge contains as effective ingredients: (a) at least one selected from the group consisting of lead styphnate, diazodinitrophenol, tetracene, silver azide, and lead azide; (b) a mixture of diazodinitrophenol and potassium chlorate, (c) a mixture of zirconium and potassium perchlorate; or (d) a mixture of at least one of potassium hexacyanoferrate and potassium hexacyanocobaltate and at least one of potassium perchlorate and potassium bichromate.

24. An electronic delay electric detonator as claimed in claim 14, wherein said ignition charge contains as effective ingredients: (a) at least one selected form the group consisting of lead styphnate, diazodinitrophenol, tetracene, silver azide, and lead azide; (b) a mixture of diazodinitrophenol and potassium chlorate; (c) a mixture of zirconium and potassium perchlorate; or (d) a mixture of at least one of potassium hexacyanoferrate and potassium hexacyanocobaltate and at least one of potassium perchlorate and potassium bichromate.

* * * * *